US005354957A

United States Patent [19]

Robertson

[11] Patent Number: 5,354,957

[45] Date of Patent: Oct. 11, 1994

[54] ARTIFICIALLY INTELLIGENT TRAFFIC MODELING AND PREDICTION SYSTEM

[75] Inventor: Euan Robertson, Polmont, Scotland

[73] Assignee: Inventio AG, Hergiswil, Switzerland

[21] Appl. No.: 49,091

[22] Filed: Apr. 16, 1993

[30] Foreign Application Priority Data

Apr. 16, 1992 [GB] United Kingdom ..... 9208466

[51] Int. Cl.[5] ..... B66B 1/18

[52] U.S. Cl. ..... 187/247; 187/387

[58] Field of Search ..... 187/127, 124, 132, 137

[56] References Cited

U.S. PATENT DOCUMENTS 5,022,497 6/1991 Thanagavelu ..... 187/124
5,024,295 6/1991 Thanagavelu ..... 187/125

FOREIGN PATENT DOCUMENTS 0348152 12/1989 European Pat. Off. .
2237663 5/1991 United Kingdom .
2245997 1/1992 United Kingdom .

OTHER PUBLICATIONS

Mechatronics, vol. 2, No. 1, Ovaska, Electronice and Information Technology in Hi-Range Systems, pp. 89–99, Feb. 19, 1992, Great Britain.

*Primary Examiner*—Steven L. Stephan
*Assistant Examiner*—Robert Nappi
*Attorney, Agent, or Firm*—Howard & Howard

[57] ABSTRACT

A system for allocating hall calls in a group of elevators includes a plurality of neural network modules to model, learn and predict passenger arrival rates and passenger destination probabilities. The models learn the traffic occurring in a building by inputting to the neural networks traffic data previously stored. The neural networks then adjust their internal structure to make historic predictions based on data of the previous day and real time predictions based on data of the last ten minutes. The predictions of arrival rates are combined to provide optimum predictions. From every set of historic car calls and the optimum arrival rates, a matrix is constructed which stores entries representing the number of passengers with the same intended destination for each hall call. The traffic predictions are used separately or in combination by a group control to improve operating cost computations and car allocation, thereby reducing the travelling and waiting times of current and future passengers.

9 Claims, 6 Drawing Sheets

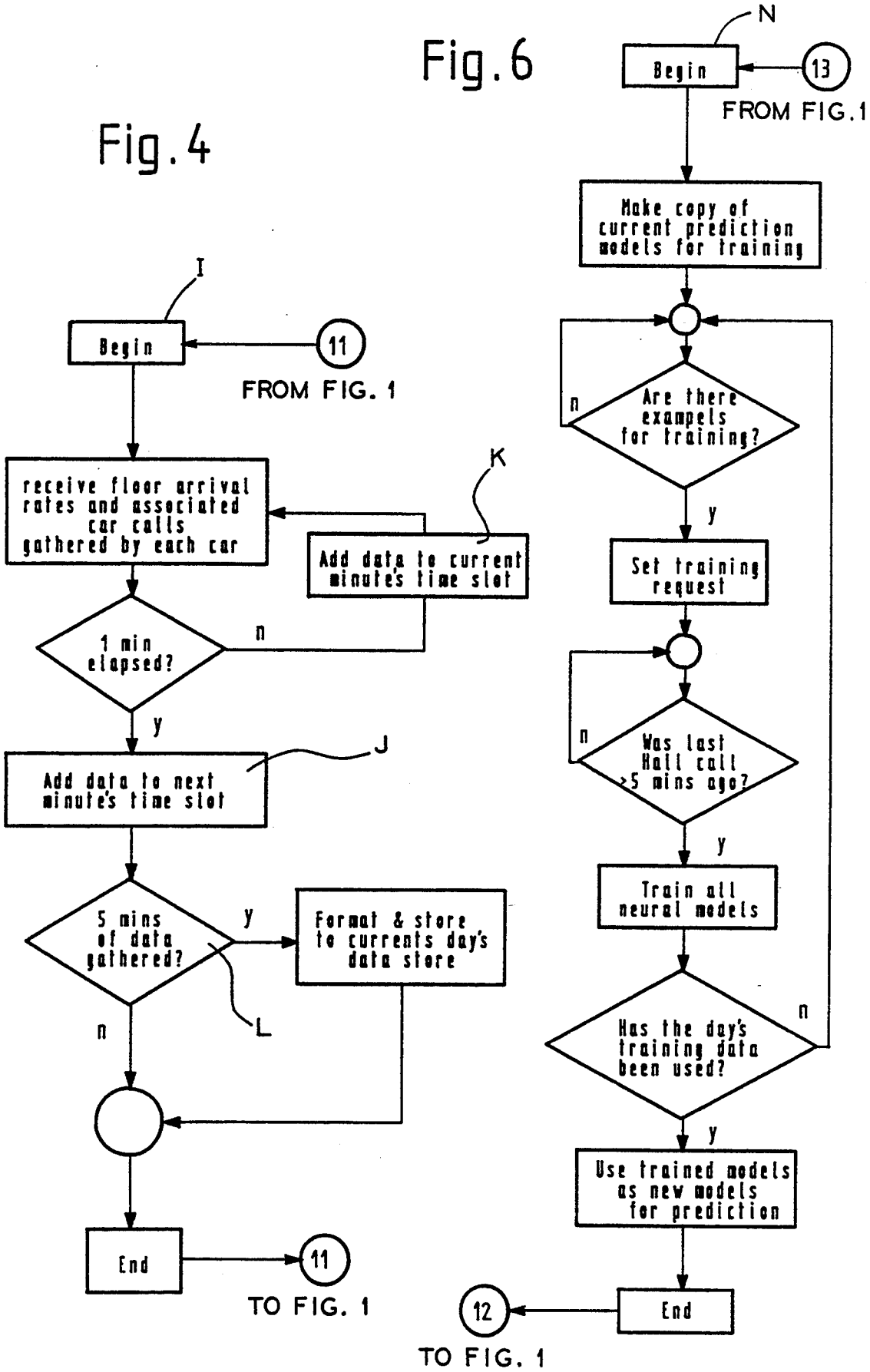
Fig. 4
Fig. 6
I
Begin
11
FROM FIG. 1
receive floor arrival rates and associated car calls gathered by each car
K
Add data to current minute's time slot
1 min elapsed?
n
y
J
Add data to next minute's time slot
5 mins of data gathered?
y
Format & store to currents day's data store
L
n
End
11
TO FIG. 1
N
Begin
13
FROM FIG.1
Make copy of current prediction models for training
Are there exampels for training?
n
y
Set training request
Was last Hall call >5 mins ago?
n
y
Train all neural models
Has the day's training data been used?
n
y
Use trained models as new models for prediction
End
12
TO FIG. 1

Fig. 5
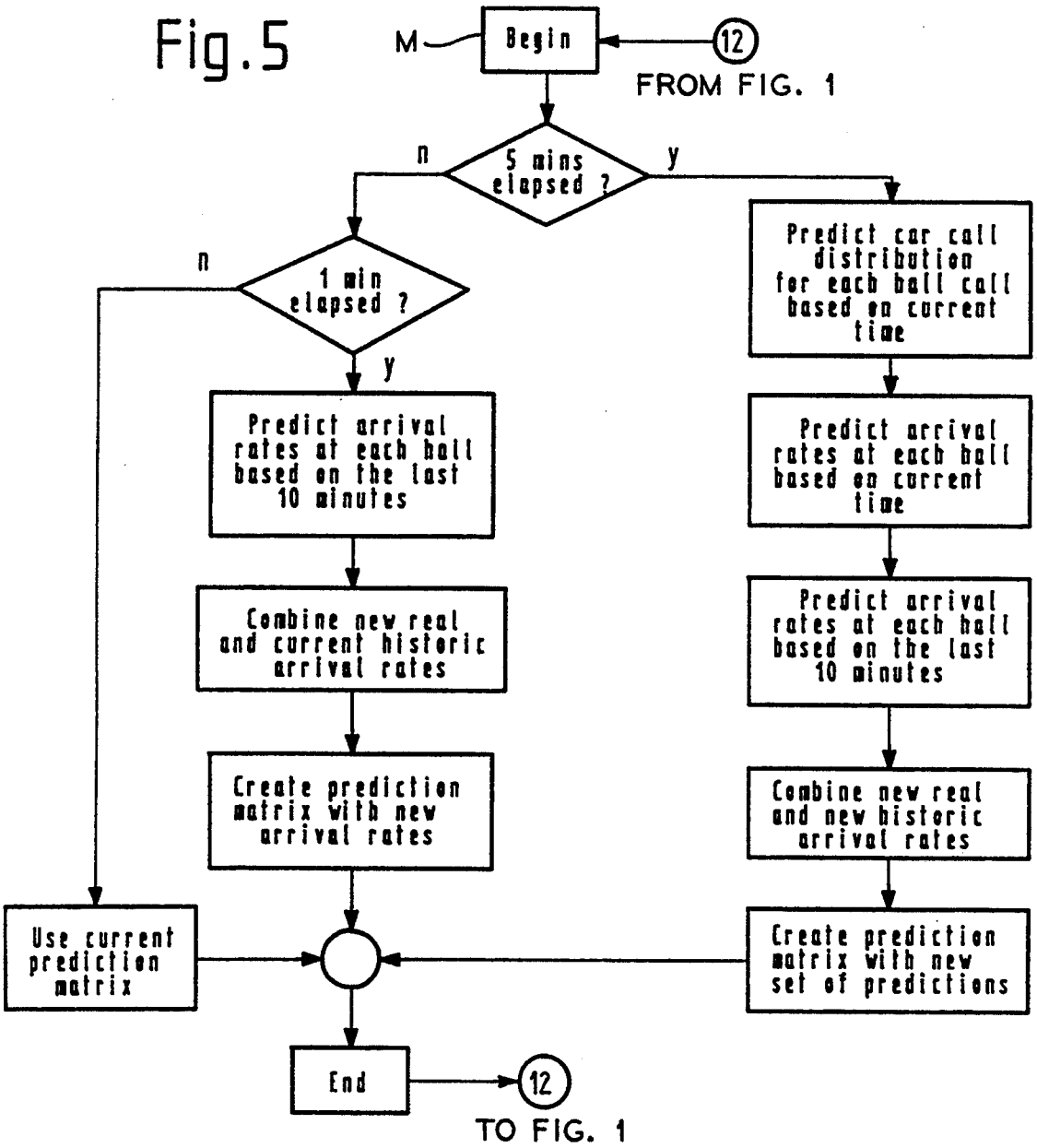
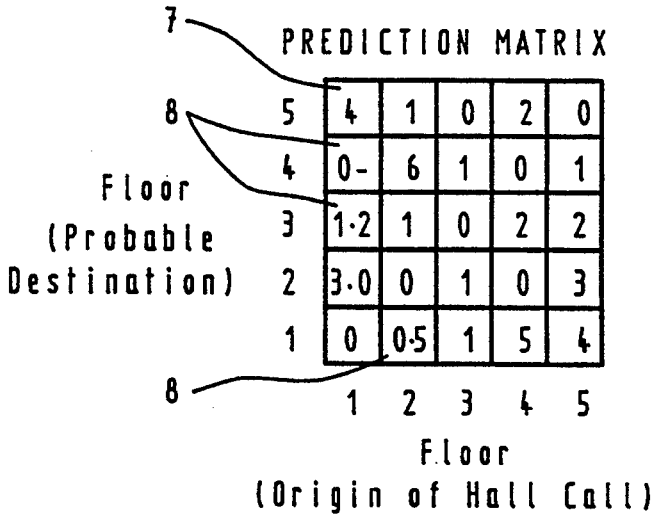

ARTIFICIALLY INTELLIGENT TRAFFIC MODELING AND PREDICTION SYSTEM

BACKGROUND OF THE INVENTION

The present invention relates generally to a method and an apparatus for modeling and predicting traffic patterns and, in particular, to a method and an apparatus for modeling and predicting traffic patterns for a group of elevators.

To date, elevator traffic modeling schemes have made wide use of queuing theory, based primarily on the Poisson distribution, to model the arrival of passengers at floors served by the elevators. Schemes have been proposed which use a single arrival rate for a whole building or an arrival rate which is unique to each individual floor. These schemes are based on the fundamental assumption that the chosen arrival rates remain unchanged throughout the daily and longer term life of the building. However, this assumption is invalid in modern buildings having smaller floor populations, where the movement of floor occupants can significantly affect their arrival rate at the elevator entrances as well as their destinations. Secondly, building usage can change significantly throughout its lifetime and, accordingly, so might the arrival rate behavior of its occupants. Finally, the poisson distribution is only regarded as an approximation to queuing behavior in an elevator context.

Recent traffic modeling schemes have attempted to solve some of the above described shortcomings in schemes utilizing queing theory by employing techniques which build tables of statistics representing important traffic events. New events are predicted and added to these tables using parameterized exponential smoothing functions. These systems only provide for discrete events, and the exponential smoothing techniques may lose valuable information. As such, statistical techniques which extrapolate their predictions from current and historical traffic events have been known for many years and can also be considered as "Artificial Intelligence". However, two general comments on these statistical techniques are appropriate: a prior interpretation of the data is often required, and subtle effects of variables on observed traffic behavior are often difficult, if not impossible, to represent.

An "Artificial Intelligence" based crowd sensing system for elevator car assignment is shown in the European patent application no. 0 385 811. In the method proposed in this patent application, observations are classified as "interesting" before they are stored or any other action taken. For example, "interesting" could be classified as two cars stopping at a floor within three minutes of each other. Such an approach relies upon the classification of "interesting" being appropriate for most events. The criteria which specify an "interesting" event are fixed and, therefore, may not be appropriate for all elevator installations. Future events are extrapolated from recent events, which are combined using an exponential smoothing technique. Long-term events are predicted from a long-term data base. Only events which are deemed to be "interesting" are considered for addition to the long term data base. After addition, events are again combined using exponential smoothing techniques. Such an approach appears to be inflexible and capable of representing only large scale events. The present invention seeks to provide a remedy for such problems and deficiencies.

SUMMARY OF THE INVENTION

The present invention concerns an artificially intelligent traffic modeling and prediction system for an elevator group control for optimizing the operation of elevator cars connected to the control by allocation of hall calls to the cars. The elevator group control calculates operating costs which correspond to waiting times and other lost times of passengers and which are calculated on the basis of the passenger traffic prevailing at the time of computation and the passenger traffic probability predicted for the time of service of a hall call. The control compares the operating costs of all cars and allocates the hall call to the car having the lowest operating costs.

The system includes a traffic data storage means for long-term and short-term storage of traffic data, the traffic data storage means having an input for receiving current traffic data from an elevator group control and having outputs. A first neural network module for modeling, learning and predicting traffic by neural network techniques has an input connected to one of the traffic data storage means outputs for receiving traffic data representing arrival rates for five minute periods. The first module has an output for generating historic traffic predictions of the predicted traffic for five minute periods on the basis of historic dam. A second neural network module for modeling, learning and predicting traffic by neural network techniques has an input connected to one of the traffic data storage means outputs for receiving traffic data representing arrival rates for a last ten minute period. The second module has an output for generating real-time traffic predictions of the predicted traffic for one minute periods on the basis of historic data. A third neural network module for modeling, learning and predicting traffic by neural network techniques has an input connected to one of the traffic data storage means outputs for receiving traffic data representing car calls for five minute periods. The third module has an output for generating historic traffic predictions of said predicted traffic for five minute periods on the basis of historic dam. A combination circuit has a pair of inputs connected to the outputs of the first and second modules for receiving and combining the historic traffic predictions and the real-time traffic predictions into an optimum traffic prediction generated at an output. A memory matrix has an input connected to the combination circuit output and another input connected to the output of the third module. The memory matrix has a plurality of data storage locations for storing data entries representing predictions for passenger destinations of the predicted traffic.

The invention relates to an artificially intelligent traffic modeling and prediction system using neural networks, especially for elevator groups, in which the function of an elevator group is optimized by a suitable allocation of all calls to cars in the serving of hall calls with regard to a function profile defined by a desired combination and weighing of elements from a predetermined set of function requirements. This suitable hall call allocation is microprocessor supported and based on operating costs, which correspond to the waiting times and other lost times of passengers and are computed on the basis of the traffic deterministically prevailing at the time of computation and the traffic probabilistically predicted for the time of service. The operating costs of all elevator cars and all hall calls are then compared and the allocation chosen which optimizes the operating costs.

The need for a more "intelligent" elevator group control system has been recognized. Consequently, the Artificially Intelligent Traffic Processor (AITP) has been designed as a number of modules or objects which interact, resulting in a more flexible and intelligent system. Techniques from the field of Artificial Intelligence have been used to implement a number of the objectives within this system. These techniques enhance the system's ability to adapt to variations in traffic patterns, use uncertain data and produce more efficient allocations. Modeling and prediction of traffic patterns has already been identified as a possible means of improving passenger service.

Accordingly, it is the purpose of the present invention to present a new approach to traffic modeling by modeling the behavior of the building population using neural network techniques. In particular, these neural network techniques shall provide a system for traffic modeling which automatically adapts to changes in traffic behavior without predefinition of events, produces results which represent relative levels of traffic as well as traffic patterns and provides predictive information for the objects within the AITP which are responsible for allocating cars.

The problems and deficiencies of the prior art traffic modeling and prediction are solved, according to the present invention, by neural networks which provide the following advantages. A first advantage can be seen in that neural networks provide distributed models, which are particularly suitable for pattern recognition and classification. It has also been found that benefits include automatic learning, scope for use of parallel processing and fault tolerance. Furthermore, neural networks can provide partial or complete solutions, when only partial or incomplete information is available. Obviously many of these characteristics are highly useful when modeling patterns of traffic where the data is noisy and often incomplete.

The invention is described in relation to the modeling and prediction of traffic in an elevator group. It is to be understood, however that the invention may be used to process traffic in other types of systems for transporting persons or handling material and that the terms "elevator", "car" and "passenger" as used in the description and claims accordingly embrace the equivalents in such other types of transport systems.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

Figure 1:
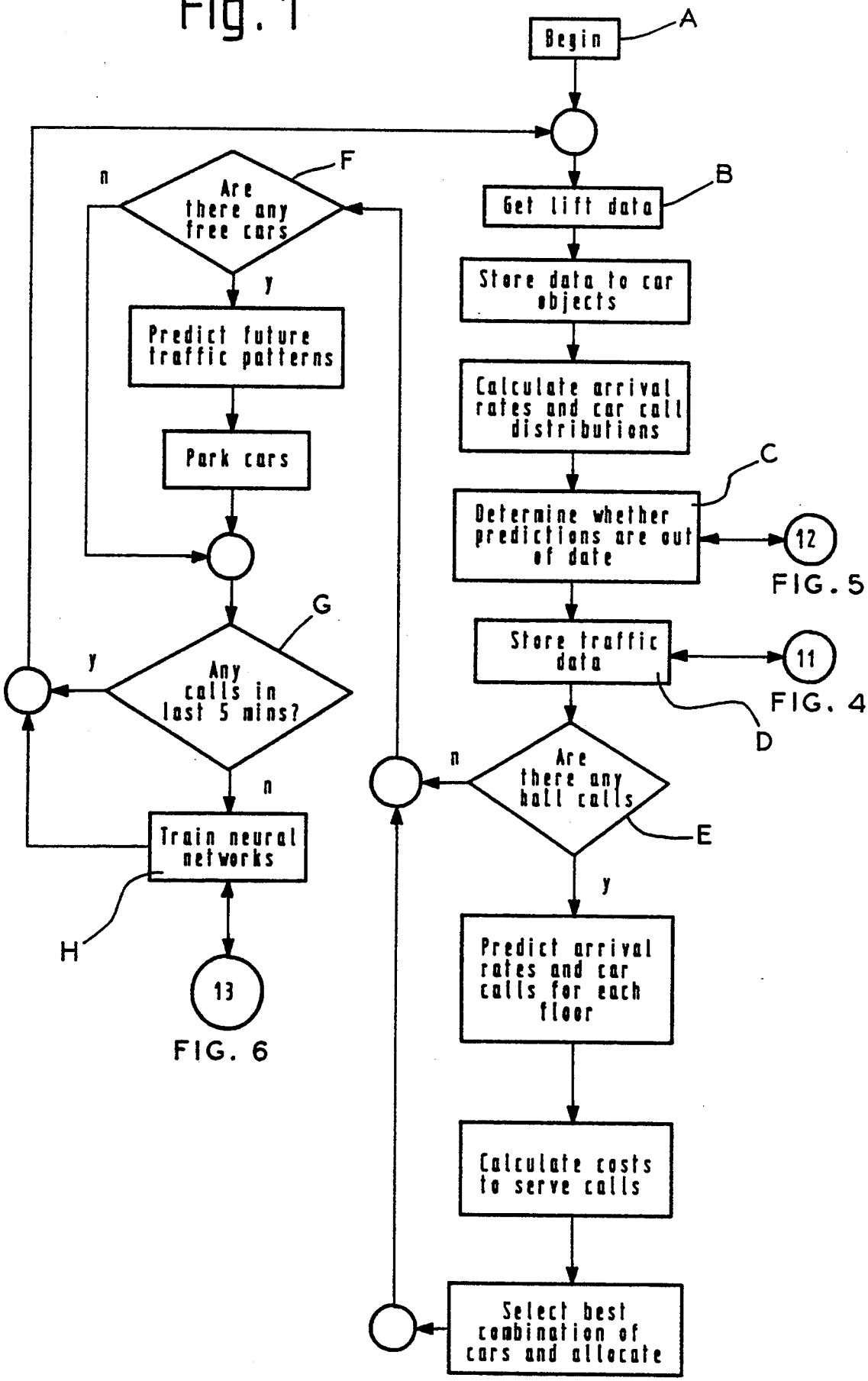
FIG. 1 is a flow diagram of a traffic modeling and prediction method according to the present invention.
Figure 7:
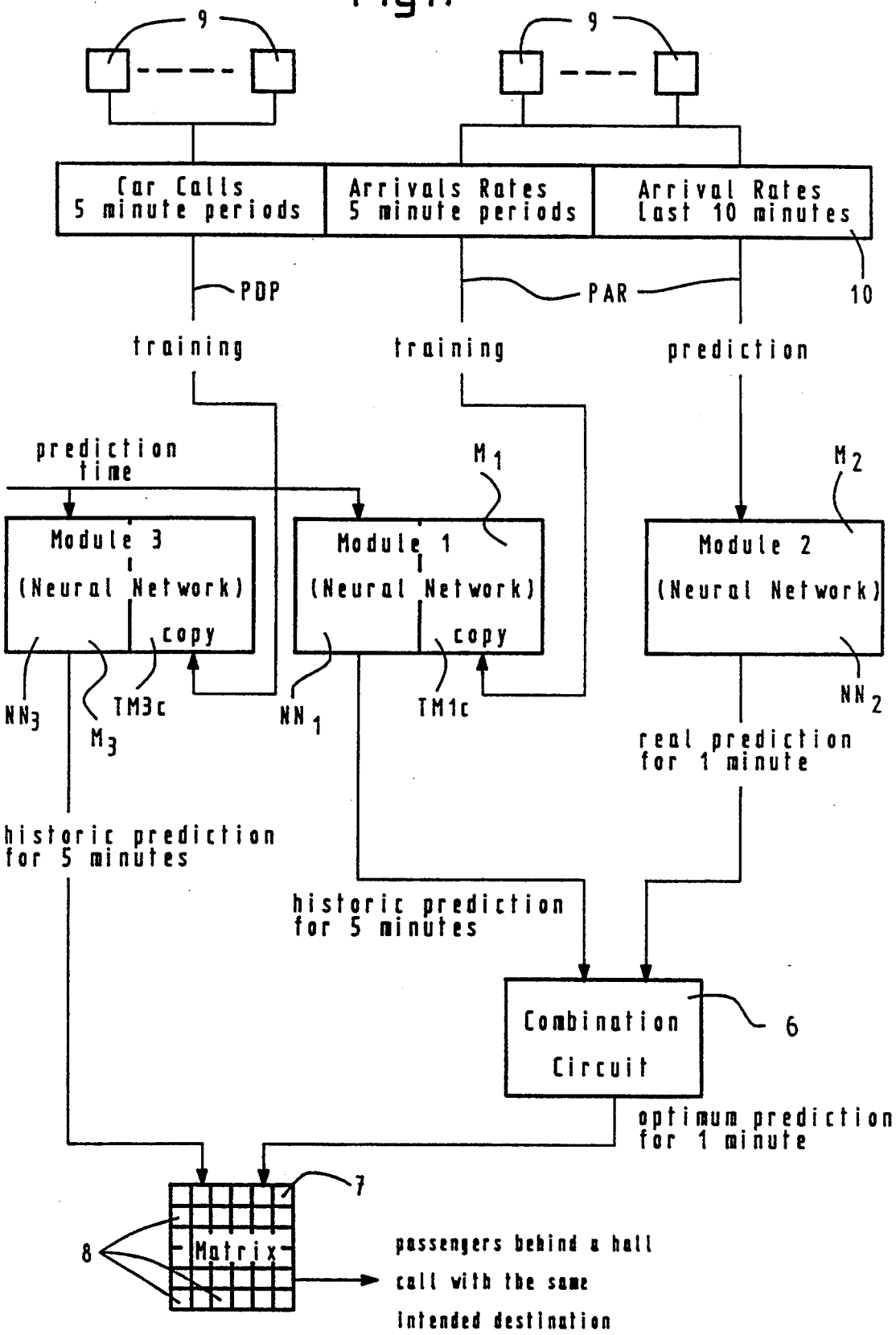

FIGS. *2a* and *2b* are perspective views of output data from two arrival rate models used in the method shown in the FIG. 1 plotted on orthogonal axes;

FIGS. *3a*, *3b* and *3c* are perspective views of output data from a car call distribution model used in the method shown in the FIG. 1 plotted on orthogonal axes;

FIG. 4 is a flow diagram of a traffic data storage module which incorporated into the flow diagram shown in the FIG. 1;

FIG. 5 is a flow diagram of a traffic prediction update module which is incorporated in the flow diagram shown in the FIG. 1;

FIG. 6 is a flow diagram of a model training module which is incorporated in the flow diagram shown in the FIG. 1; and FIG. 7 is a schematic block diagram of an apparatus for performing the operations according to the method illustrated in the FIGS. 1 through 6.

DESCRIPTION OF THE PREFERRED EMBODIMENT

In the FIG. 1 there is shown a flow diagram of the general operation of an Artificially Intelligent Traffic Processor (AITP) utilizing a method in accordance with the present invention for operating an elevator control system. In order to fulfill the predicted data requirements of the cost calculation and hall call allocation objectives of the elevator group control, the passenger population behavior is represented by modeling two major characteristics of their travels: the distribution of passenger arrival rates (i.e., the hall call distribution) for each floor and car direction throughout the day and the passenger destination probability (i.e., the car call distribution) for each floor throughout the day.

Of particular interest are the operations which involve traffic modeling and prediction. Three major operations are performed in this respect:

I. Short-term storage, formatting and long-term storage of traffic data (see a subroutine shown in the FIG. 4).

II. Updating of the current traffic predictions according to the time of day and recent traffic behavior (see a subroutine shown in the FIG. 5).

III. Training of the neural network modules using the traffic data stored in the long-term data storage (see a subroutine shown in the FIG. 6).

On the basis of the aforementioned two major traffic characteristics, one can predict the number of passengers requiring travel from a given floor and produce a measure of their likely destinations.

The method of allocating hall calls shown in the FIG. 1 can be implemented in a number of different apparatuses. Although the apparatus could be formed as a circuit of discrete logic elements, the preferred embodiment is a software program running in a computer provided in an elevator group control. The program starts at a step A "Begin" and runs through a series of instruction steps beginning at a step B "Get lift dam" wherein data on the current passenger traffic in the elevator cars in the group is inputted and ending at a step C where it is determined whether the current predictions of passenger arrival rates and car call distributions for hall calls are out of date. In order to make such a determination, the program exits at a circle 12 to a subroutine in a traffic prediction update module shown in the FIG. 5 and returns to the step C when the determination is complete. The program next enters an instruction step D "Store traffic data" wherein the program exits at a circle 11 to a subroutine in a traffic data storage module shown in the FIG. 4 and returns to the step D.

The program next enters a decision step E "Are there any hall calls". If at least one hall call has been entered by a person desiring elevator service, the answer is yes and the program branches from the step E at "y" to a series of instruction steps which predict arrival rates and car calls for each floor, calculate the costs for each car to serve the hall call, select the best combination of cars and allocate the hall call accordingly. If the answer is no, the program branches from the step E at "n". Both branches from the step E enter a decision step F which checks for free cars, i.e. cars without car calls and allocated hall calls. If the answer is yes, the program branches from the step F at "y" and executes two instruction steps which predict future traffic patterns and park the free cars at selected floors. If the answer is no, the program branches from the step F at "n". Both branches from the step F enter a decision step G which checks for hall calls in the last five minutes. If the answer is no, the program branches from the step G at "n" and enters an instruction step II "Train neural networks". The program exits at a circle 13 to a subroutine in a model training module shown in the FIG. 6 and returns to the step H. If the answer is yes, the program branches from the step G at "y". Both branches from the step G return to a point between the steps A and B and the program recycles.

Figure 2A:
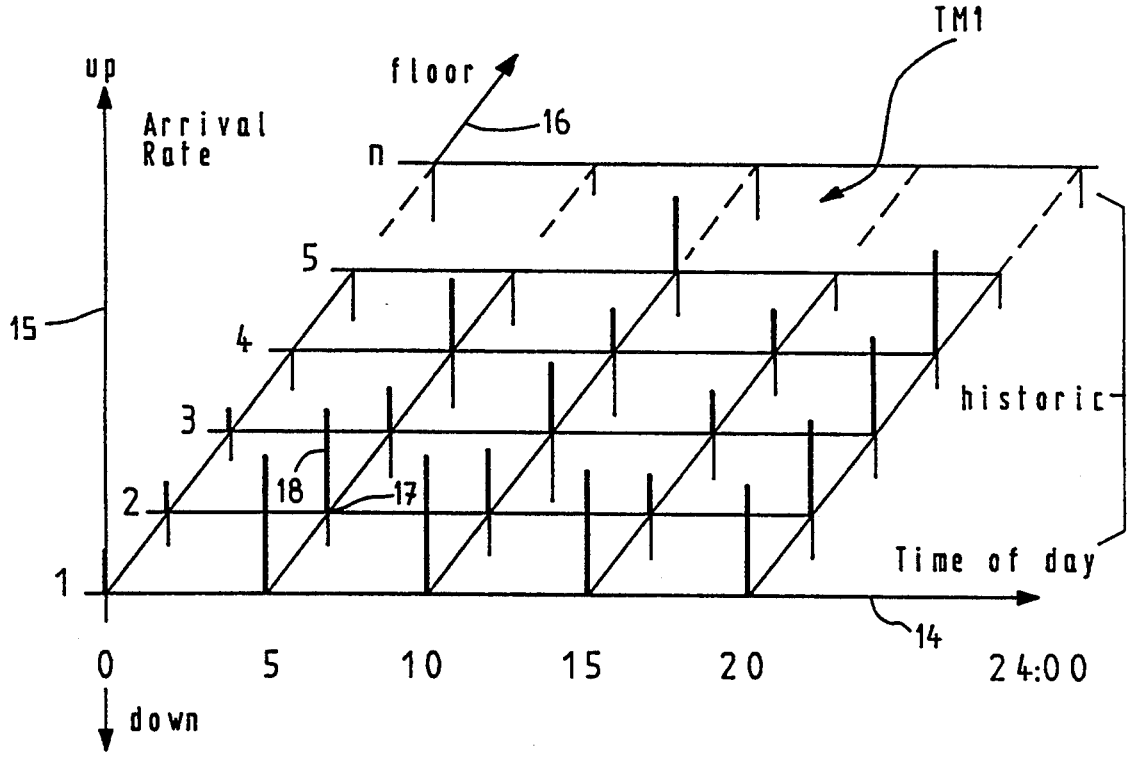
Figure 2B:
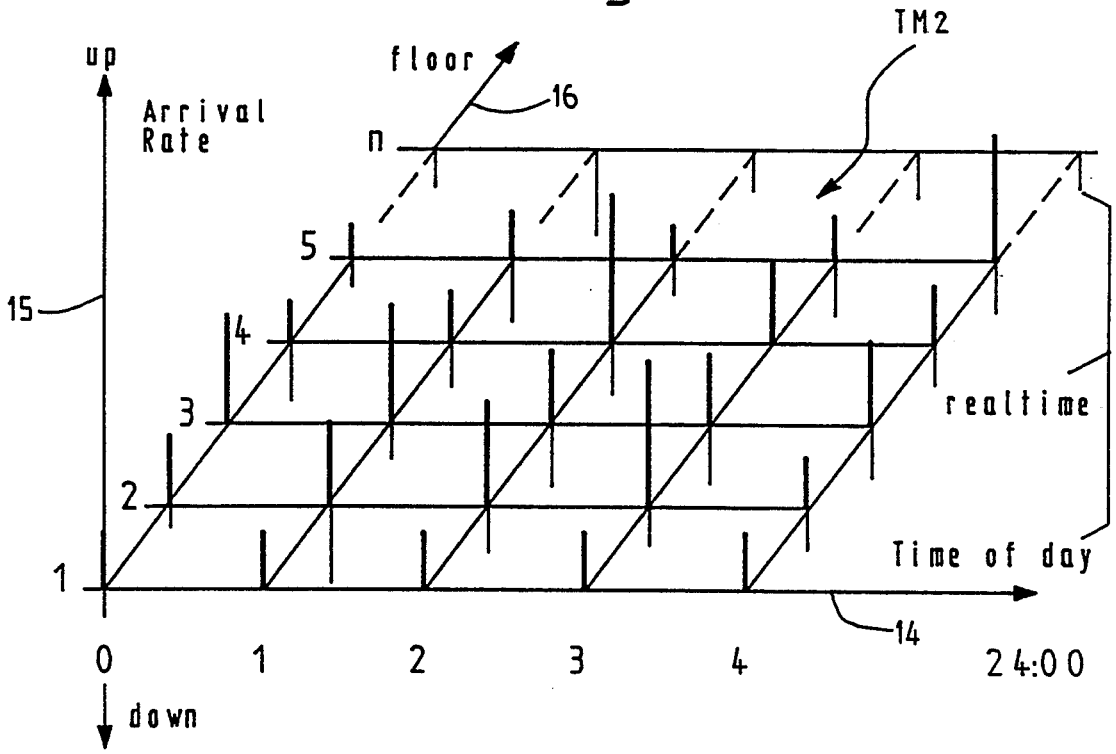

There is shown in the FIGS. 2*a* and 2*b* a pair of plots of output data from modeling the traffic characteristic "Passenger Arrival Rates". In each figure, the output data is plotted on a set of orthogonal axes. An "x" axis 14 represents the time of day in five minute increments in the FIG. 2*a* and one minute increments in the FIG. 2*b* from "0" hours to "24:00" hours. A "y" axis 15 represents the desired direction of travel as "up" and "down". A "z" axis 16 represents the floors served by the elevator system from a floor number "1" through a floor number "n".

Two models have been developed which model passenger arrival rates and produce a vector of passenger arrival rates, one element per floor and direction, for a given time in the future. This information can then be used to predict the number of passengers represented by current and future hall calls. A first traffic model TM1, called an "Historical Arrival Rates Model" and shown in the FIG. 2*a*, continuously learns passenger arrival rate patterns throughout the working day of the elevator system by sensing the hall calls entered. This model has been implemented with neural network techniques and this process is referred to as neural network training. The model can, when given the current time of day, predict the passenger arrival rates for each floor and direction of travel in the building at a specified time in the future. The model represents the correspondence between different input patterns and their resulting output patterns. Input patterns are coded binary versions of time of day, and day of the week. Output patterns, shown in the FIG. 2*a* at the intersections of the increments along the "x" axis 14 and the "z" axis 16, represent the arrival rates for each floor and direction in the building. Therefore, the training data set is comprised of input/output pattern pairs for a day's traffic behavior. Each pair represents the arrival rates behavior at each floor for a five minute period. For example, at an intersection 17 of the floor number "2" and the first five minute increment "5", there is shown a vector 18 representing the passenger arrival rate for the up and down directions of travel.

The second traffic model T1Vi2, called a "Real Arrival Rates Model" and shown in the FIG. 2*b*, is also based on neural network techniques and produces predictions of future passenger arrival rates. However, unlike the first model, these predictions are extrapolated from recent passenger arrival rate behavior at each floor. This approach is similar to current systems. However, by using neural network techniques a more robust extrapolation function is obtained which represents the actual arrival rate behavior, not a predefined statistical distribution.

Figure 3A:
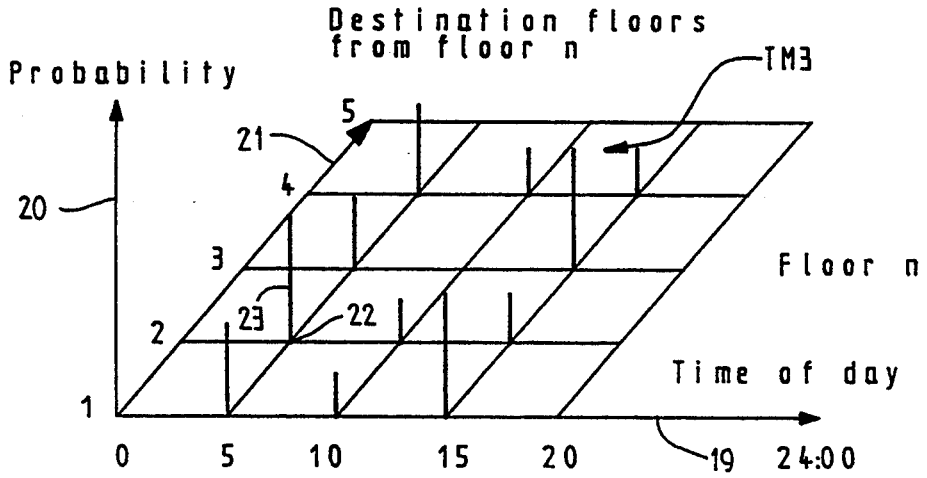
Figure 3B:
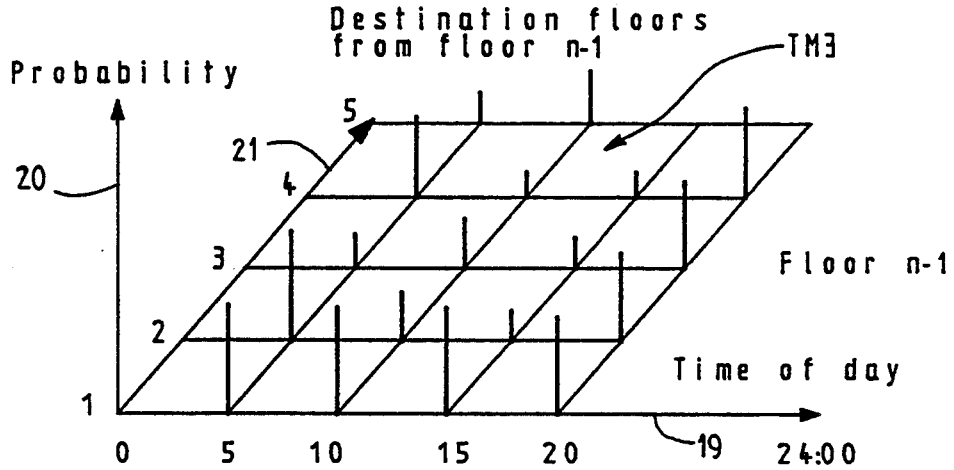
Figure 3C:
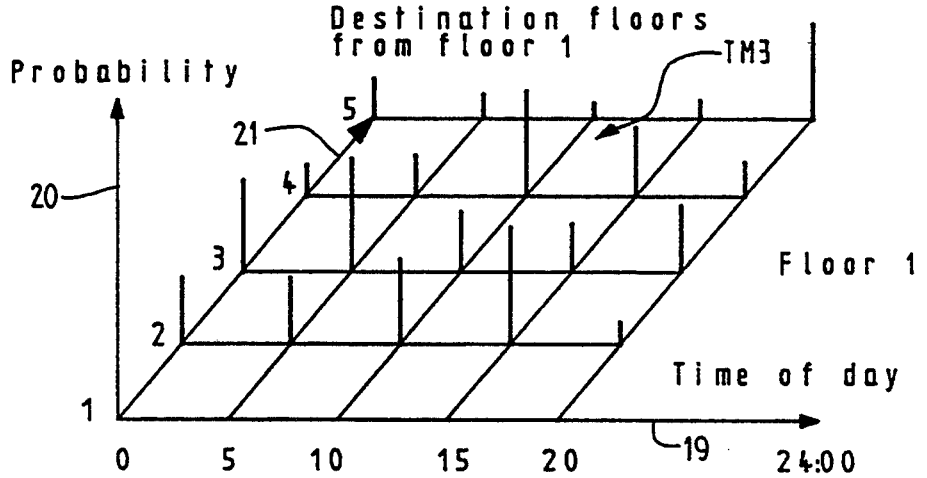

The model output data distributions shown in the FIGS. 3*a*, 3*b* and 3*c* concern modeling the traffic characteristic "Car Call Distribution". To this end, a third traffic model TM3, called "Car Call Distribution Model", models the distribution of car calls which is observed for each floor throughout the day. A car call is a request for travel to a destination floor entered by a passenger either in the elevator car or at a floor depending upon the type of hall call and car call entry devices used. This call data allows destinations for current and future hall calls to be estimated. Destinations of passengers for registered car calls can be used in calculations such as the highest reversal floor and number of intermediate stops. The Car Calls Distribution Model TM3 continuously learns the patterns of car calls which occur at each floor throughout the working day of an elevator system. The model can then produce predictions of car calls which may occur according to the current time of day. The model trains itself in an identical manner to the Historical Arrival Rates Model TM1. However, the arrival rate output pattern is replaced by the car call probability distribution for each floor in the building. Therefore, the pattern pairs are time and car call distribution for each floor during each five minute period of the day.

The outputs from modeling the traffic characteristic "Car Call Distribution" are plotted on a set of orthogonal axes. An "x" axis 19 represents the time of day in five minute increments from "0" hours to "24:00" hours. A "y" axis 20 represents the probability of passengers. A "z" axis 21 represents the destination floors served by the elevator system from the floor number "n" in the FIG. 3*a*, the floor number "n-1" in the FIG. 3*b* and the floor number "1" in the FIG. 3*c*. For example, in the FIG. 3*a* at an intersection 22 of the floor number "2" and the first five minute increment "5", there is shown a vector 23 representing the car call probability.

The FIGS. 4, 5 and 6 show flow diagrams of subroutines in modules which are entered from the program flow diagram shown in the FIG. 1. These subroutines concern the production of predictions, when required, for making car cost calculations and hall call allocation. Allocation of elevator cars may take two forms: first to answer current hall calls, and second to park cars at areas where future high traffic demands are expected.

In the FIG. 4, the subroutine is entered from the circle 11 into a step I "Begin". The data required for traffic prediction is collected, formatted and stored by the subroutine. Traffic data is transmitted from the elevator system car data storage to the subroutine traffic data storage. This data can take two forms, either floor arrival rate or car call data. The two forms are received separately together with a time-stamp which indicates which minute period (see FIG. 3*b*) of the day the dam describes. This time-stamp is checked against the current data time-stamp. In each minute period, there will be a set of arrival rate and car call data for each car. If the data time-stamp is different, it is saved for the relevant time slot in an instruction step J. If the data belongs to the current time slot, it is added to data present for that time slot in an instruction step K. For example, in an "N" car group there will be "N" sets of arrival data and "N" sets of car call data for each minute. The arrival rates are added together for each floor/direction to give a total arrival rate value for that minute period. That same process is carried out for car calls. Lastly, if a new five minutes' worth of data has been gathered as determined in a decision step L, i.e., five times "N" cars, then the accumulated values for arrival rates and car calls are formatted together with a time-stamp which represents the five minute period in the day and stored in the long-term storage. The subroutine then ends and returns to the main program (FIG. 1) at the instruction step D.

The description and format of this data can be detailed as follows: throughout the day passenger behavior data is stored for each five minute period. Two types of data are stored: the rate at which passengers arrive over a specific five minute period and the probability distribution of car calls for each floor during a five minute period. In both cases, there are two hundred eighty-eight five minute periods in a day.

Common to both models is the input training (learning) data, which is time. The output data is model-dependent, i.e., arrival rates or car call distributions. Time is represented as the time of day (in 5 minute periods), day of the week, and month of the year. Each of these sub-fields is coded as a binary integer, for use with the neural network. The arrival rate and car call data is represented as a real number.

For each five minute period, one arrival rate vector is stored in the training file in the following format:

| | | | |
|---|---|---|---|
| 01001101100 | 0000 | 000 | 0 0.21 0.10 . . . etc. |
| time of day | month | day | arrival rates |
| input | | | output |

The arrival rates are for each floor and direction, i.e., ground floor up, first floor up, first floor down, etc.

As there is a destination model for each floor in the building, then there is a car call probability vector for each floor. For a ten floor building, there will be ten vectors for a five minute period in the following format:

| | | | |
|---|---|---|---|
| 01001101100 | 0000 | 000 | 0 0.51 0.49 . . . etc. |
| time of day | month | day | car call |

The car call probabilities are for each possible destination floor. Concurrently with this five minute period operation, the last ten one-minute periods of arrival rates are kept up to date for use by the real-time prediction module.

Having stored the required traffic data by the procedure shown in the FIG. 4, the FIG. 5 illustrates the production of timely predictions to be used by the cost calculation and car allocation objects. When the module shown in the FIG. 5 is called, the subroutine is entered at the circle 12 and a step M "Begin". The current time is compared to the last time historical predictions were made. If the difference is greater than or equal to five minutes, then new predictions of arrival rates and car call distributions are made for each floor and direction. Arrival rate predictions are also made based on the previous ten minute's arrival rates for each floor and direction. These real-time predictions are combined with the historically based predictions to produce an optimum set of arrival rate predictions. Finally, a memory matrix 7 is constructed from the predicted car calls and arrival rates. Each data storage location 8 in the matrix 7 contains data which represents the number of passengers with the same intended destination that are associated with a hall call. If five minutes have not elapsed since the last historical predictions, the current time is checked against the last time a real-time prediction was made. If this is greater than or equal to one minute, than a new set of real-time arrival rates is produced based on the previous ten minutes arrival rate behavior. These predictions are then combined with the current set of historical arrival rate predictions to give a new set of optimum arrival rate predictions. These optimum values are then combined with the current car call predictions to produce a new prediction memory matrix 7. If both of the above tests fail, then the current prediction memory matrix 7 is used. The subroutine ends and returns to the main program at the instruction step C.

The FIG. 6 illustrates how the behavior of the building population is learned, because neural networks predict future events from what they have observed in the past. When the module shown in the FIG. 6 is entered at the circle 13, the subroutine is started at a step N and makes copies of the historical arrival rate and car call models because the originals must be available for current predictions. These copies will be used for training with the data which is present in the long term data store. If there are examples available for training purposes, a training request flag is set. If the AITP scheduler detects that no hall calls have been registered for five minutes, the arrival rate and car call models are trained with a specified number of traffic examples. The number of traffic examples is limited to allow the scheduler to interrupt training if a hall call is registered. Such an approach has given rise to the concept of the "dreaming elevator" which processes data when the building is quiet. This process continues until the entire example set For the previous working day has been used. At that point, the networks for prediction purposes are those networks which have just undergone training. The subroutine ends and returns to the main program at the step H.

Finally, the artificially intelligent system, used to perform the operations according to the modules shown in the FIGS. 4, 5 and 6, is represented in the FIG. 7. As outlined in the FIGS. 2*a*, 2*b*, 3*a*, 3*b* and 3*c*, the three traffic models TM1, TM2, TM3 have been designed for characterizing traffic in the approach adopted for the AITP. In order to improve the modelling and predictive behavior of this approach, all three models, T1VI1, T1VI2 and TM3, have been implemented with "Neural Networks" NN1, NN2 and NN3 respectively (a set of techniques from the field of Artificial Intelligence).

Neural networks provide distributed associative models applying concepts analogous to the structure of the brain. Current neural networks are highly simplified versions of their biological counterparts, but significant results have been achieved in a diversity of application areas. Particular successes have been recorded in the area of pattern matching, classification and forecasting. Neural networks used for pattern matching learn or train themselves by being presented with examples, i.e., input and the desired output pairs. They then adjust their internal structure to represent the transformations between the input and output patterns. Thus when presented with an input pattern they can reproduce the desired output. Applied in elevator installations, neural network technology provides the mechanism for dynamically learning the behavior of a building population and accordingly predicting future events based on what has been learned. Unlike previous schemes, which use classical statistics, neural networks require no prior assumption of the underlying mathematical models, automatically learning and adapting a model according to the building behavior which occurs. Models are built from the observed behavior, and no pre-set values for arrival rates are required. Indeed, these values are seen as a major failing of previous systems. Using neural networks techniques these models can be placed in a variety of buildings and left to learn the actual traffic patterns automatically. There is no need to predefine traffic events; output from these models simply predicts the level of traffic expected based on previous observations. This is especially important where behavior which previously was defined as heavy is now average when compared to other floors. Current approaches cannot provide such flexible and autonomous behavior. As a preferred embodiment of this invention, population behavior is modeled using a "Backpropogation" neural network approach as described in "Parallel Distributed Processing", Rumelhart, D. E., McClelland J. L., Chap. 8. This approach has been found to be the most flexible.

The Rumelhart and McClelland publication provides a detailed description of Backpropagation networks. These networks consist of multiple layers of processing elements. Typically there are three layers; the input layer, the hidden layer and the output layer. The number of elements in each layer is a variable and dependent upon the application. If ten inputs and five outputs are required, then the input layer will have ten processing elements and the output layer five processing elements. Each processing element is connected to every processing element in the preceding layer. It is the strength of these connections, called weights, that store the knowledge learned by the network. This is analogous to the dendritic connections and synaptic gaps in the human brain.

Backpropagation networks learn and store patterns by adjusting the weights for each input and desired output pattern presented. If the network does not produce the correct output pattern for a given input pattern, the Backpropagation method assumes that all processing elements and connection weights are somewhat to blame. The difference between the desired output and the output vectors produced is represented by a vector of errors. The responsibility for these errors is affixed by propagating the individual errors backward to the previous layers until the input layer is reached. Each processing element then attempts to reduce the root mean squared error between its own desired and actual outputs. This is done by adjusting each output connection weight for each processing element.

This is in fact how a Backpropagation network learns. A training set which contains many input and desired output pairs is presented to the network. At first, because the weights are completely untrained, the error between the actual and desired outputs will be large. However, as each pair is presented, usually many times, the size of the error is reduced until the weights reach a steady state. The result is a set of weights which represent the network's attempt at a generalized mapping for all input/output pairs.

In the prediction mode, there is no change made to any of the weights. When the network is used in the prediction mode, an input is presented to the input layer. Using the learned set of weights, an output pattern is produced by propagating the output of each processing element along each connection to the input of elements in the following layer. The strength of each connection determines how much of the preceding processing elements' outputs are used as input to the processing elements in the following layer. This process is continued until the output layer is reached. The output is therefore created by feeding the input forward through the network mapping the inputs using the learned set of weights.

Thus, as shown in the FIG. 7, current passenger traffic data for elevator cars in a group is stored by the group control in a plurality of memory locations 9. Outputs from the memory locations 9 are connected to inputs of a traffic data storage means or memory 10. This data can take two forms, either car call data (passenger destination probabilities PDP) or passenger arrival rates (PAR) data. The car calls data for five minutes periods, the arrival rates for five minute periods and the arrival rates for the last ten minutes are stored in the memory 10. Outputs from the memory 10 are connected to inputs of a Module 1 M1 representing the traffic model TM1, a Module 2 M2 representing the traffic model TM-12 and a Module 3 M3 representing the traffic model TM3. The modules M1, M2 and M3 are implemented as neural networks NN1, NN2 and NN3 respectively. Since the traffic models TM1 and TM3 predict future events based upon what they have observed in the past, copies TM1c and TM3c respectively are trained with input/output pattern pairs for the day's traffic behavior. Input patterns are coded binary versions of time of day generated as "prediction time" by the group control at inputs to the modules M1 and M3. Output patterns are the arrival rates or the car call probability distributions for each floor generated at outputs. The real arrival rate model TM2 does not explicitly use time as an input. Also, time is already combined with the training dam, so it is not required as an input for training the copies TM1c and TM3c of the models TM1 and TM3 respectively.

The passenger arrival rates from the two modules M1 and M2 are generated at the module outputs which are connected to inputs of a combination circuit 6. The arrival rates are combined in the combination circuit 6 to generate optimum arrival rates, producing an optimum prediction result which can allow for exceptional traffic behavior. For instance, the Historical Arrival Rates model will predict future events based on what commonly occurs. If a particular floor is empty one day for an exceptional reason, the model will predict traffic for that floor based on previous behavior. However, the Real Arrival Rates model will adjust these predictions, on the basis of recent events over the last ten minutes. In this case zero arrival rates for the last ten minutes would lead to an extrapolated value of zero arrivals for the next minute.

An output of the combination circuit 6 is connected to one input of the memory matrix 7 and an output of the module M3 is connected to another input of the memory matrix 7. Thus, the matrix 7 is constructed from the predicted car calls and arrival rates. Each entry in a data storage location 8 in the matrix 7 represents the number of passengers associated with a hall call with the same intended destination. The matrix 7 is renewed for one and five minute periods.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An artificially intelligent traffic modeling and prediction system for an elevator group control for optimizing the operation of elevator cars connected to the control by allocation of hall calls to the cars, the elevator group control calculating operating costs which correspond to waiting times and other lost times of passengers and are calculated on the basis of the passenger traffic prevailing at the time of computation and the passenger traffic probability predicted for the time of service of a hall call, comparing the operating costs of all cars and allocating the hall call to the car having the lowest operating costs, the system comprising:

a traffic data storage means for long-term and short-term storage of traffic data, said traffic data storage means having an input for receiving current traffic data from an elevator group control and having outputs;

a plurality of neural network modules for modeling, learning and predicting traffic by neural network techniques, said modules each having an input connected to one of said traffic data storage means outputs and having an output, said modules modeling and predicting traffic by representing at least one characteristic of predicted traffic for a predetermined longer time period and for a predetermined shorter time period and generating historic traffic predictions of said predicted traffic on the basis of historic data and generating real-time traffic predictions of said predicted traffic on the basis of recent data;

a combination circuit having a pair of inputs connected to said outputs of two of said modules for receiving and combining said historic traffic predictions and said real-time traffic predictions into an optimum traffic prediction generated at an output; and a memory matrix having an input connected to said combination circuit output and another input connected to said output of another one of said modules, said memory matrix having a plurality of data storage locations for storing data entries representing predictions for another characteristic of said predicted traffic.

2. The system according to claim 1 wherein said neural network modules are "Backpropogation" neural networks.

3. The system according to claim 1 wherein said one characteristic is passenger arrival rates and said another characteristic is passenger destinations.

4. The system according to claim 1 wherein said data entries in said memory matrix each represent a number of passengers with an associated same intended destination.

5. An artificially intelligent traffic modeling and prediction system for an elevator group control for optimizing the operation of elevator cars connected to the control by allocation of hall calls to the cars, the elevator group control calculating operating costs which correspond to waiting times and other lost times of passengers and are calculated on the basis of the passenger traffic prevailing at the time of computation and the passenger traffic probability predicted for the time of service of a hall call, comparing the operating costs of all cars and allocating the hall call to the car having the lowest operating costs, the system comprising:

a traffic data storage means for long-term and short-term storage of traffic data, said traffic data storage means having an input for receiving current traffic data from an elevator group control and having outputs;

a first neural network module for modeling, learning and predicting traffic by neural network techniques, said first module having an input connected to one of said traffic data storage means outputs for receiving traffic data representing arrival rates for five minute periods and having an output, said first module generating historic traffic predictions of said predicted traffic for five minute periods on the basis of historic data;

a second neural network module for modeling, learning and predicting traffic by neural network techniques, said second module having an input connected to one of said traffic data storage means outputs for receiving traffic data representing arrival rates for a last ten minute period and having an output, said second module generating real-time traffic predictions of said predicted traffic at one minute intervals on the basis of said arrival rates for the last ten minute period;

a third neural network module for modeling, learning and predicting traffic by neural network techniques, said third module having an input connected to one of said traffic data storage means outputs for receiving traffic data representing car calls for five minute periods and having an output, said third module generating historic traffic predictions of said predicted traffic for five minute periods on the basis of historic data;

a combination circuit having a pair of inputs connected to said outputs of said first and second modules for receiving and combining said historic traffic predictions and said real-time traffic predictions into an optimum traffic prediction generated at an output; and a memory matrix having an input connected to said combination circuit output and another input connected to said output of said third module, said memory matrix having a plurality of data storage locations for storing data entries representing predictions for passenger destinations of said predicted traffic.

6. The system according to claim 6 wherein said first, second and third modules are "Backpropogation" neural networks.

7. The system according to claim 5 wherein said data entries in said memory matrix each represent a number of passengers with an associated same intended destination.

8. The system according to claim 3 wherein said passenger arrival rates and said passenger destinations are both predicted for five minute periods throughout a day and said passenger arrival rates are predicted at one minute intervals based upon said current traffic data for a previous ten minutes.

9. The system according to claim 8 wherein said two modules connected to said combination circuit are a first module for predicting said passenger arrival rates for five minute periods throughout the day and a second module for predicting said passenger arrival rates at one minute intervals based upon said current traffic data for a previous ten minutes, and said another one of said modules is a third module for predicting said passenger destinations for five minute periods throughout the day.

* * * * *